US006896003B1

(12) United States Patent
Gieseke

(10) Patent No.: US 6,896,003 B1
(45) Date of Patent: May 24, 2005

(54) HIGH EFFICIENCY LOW ACTUATION FORCE INLET DOOR

(75) Inventor: Thomas J. Gieseke, Newport, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 254 days.

(21) Appl. No.: 10/292,954

(22) Filed: Nov. 12, 2002

(51) Int. Cl.[7] ..... A01G 25/09
(52) U.S. Cl. ..... 137/899.4; 137/833; 251/62; 251/299; 114/239
(58) Field of Search ..... 137/899.4, 833; 114/238, 239; 251/298, 299, 62, 359

(56) References Cited

U.S. PATENT DOCUMENTS 868,946 A * 10/1907 Smulders ..... 114/238
925,707 A * 6/1909 Lake ..... 114/239
3,011,307 A * 12/1961 Edelfelt ..... 137/15.1
4,307,743 A * 12/1981 Dunn ..... 137/15.1
4,372,505 A * 2/1983 Syberg ..... 244/53 B
4,620,679 A * 11/1986 Karanian ..... 244/53 B
5,088,660 A * 2/1992 Karanian ..... 244/53 B
6,264,137 B1 * 7/2001 Sheoran ..... 244/53 B

* cited by examiner

*Primary Examiner*—A. Michael Chambers
(74) *Attorney, Agent, or Firm*—James M. Kasischke; Michael F. Oglo; Jean-Paul A. Nasser

(57) ABSTRACT

An inlet system for an inlet in a flow field includes an inlet recess housing having an interior with forward and rear end walls, a base wall, and an opening formed in an upper surface thereof. An intake duct is formed in a rear end wall of the inlet recess. An inlet door has a first end pivotally connected to a forward wall and a trailing edge directed to the rear end wall of the inlet housing such that the inlet door selectively closes the opening of the inlet housing. An overlap member can extend from the rear end wall of the inlet recess to a predetermined distance adjacent a trailing edge of the door. A deflector is provided having an end deflecting portion in contact with the trailing edge of the door over at least a portion of the inlet door's pivoting path. Side deflecting portions project from the end deflecting portion toward the front wall of the inlet housing. The deflector controls pressure recovery of flow field at a fully open position of the door until the trailing edge of the door clears the end deflecting portion of the deflector.

7 Claims, 2 Drawing Sheets

HIGH EFFICIENCY LOW ACTUATION FORCE INLET DOOR

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

This invention generally relates to an intake door system that efficiently recovers the dynamic pressure in an external flow around a moving vehicle and does not suffer from opening resistance forces generated through pressure recovery in the inlet recess.

(2) Description of the Prior Art

In the current art for submarine torpedo launch systems designs (as generally shown in FIG. 1), a high efficiency inlet 100 is included at an intake side of the system. This inlet 100 includes a recess 102, an intake duct 104 and a hinged door 106. The door 106 is designed so that when it is opened, the dynamic pressure of the mean flow is channeled directly into the intake duct 104. This pressure is intended to assist a turbine pump 118 in launching a torpedo 116 from a torpedo tube 108.

The basic operation of the type of launch system shown in FIG. 1 is as follows. The inlet door 106, a slide valve 110, and a shutterway recess 112 are opened to create an open flow path through the launch system. Prior to launch, the pressure in the inlet recess 102 and the pressure in the shutterway recess 112 each independently increase to some fraction of the available dynamic head, as a result of forward motion of the platform. Any imbalance in the pressure in these two recesses 102, 112 causes fluid in the launch system, and any device, such as torpedo 116, in the torpedo tube 108, to begin to move. When launch is initiated, the turbine pump 118 begins to rotate and fluid is drawn through the inlet door 106, the inlet recess 102, and the intake duct 104 and into the turbine pump 118. The turbine pump 118 forces fluid into an impulse tank 114 housing the slide valve 110, through the slide valve 110, down the torpedo tube 108 and thereby carrying the weapon 116 in the torpedo tube 108 through the shutterway recess 112 and out of the platform.

In practical systems, the inlet door 106, when fully open, does not effectively direct the external dynamic pressure into the intake duct 104. A second problem is that when the inlet door 106 just begins to open, the dynamic pressure is effectively channeled into the inlet recess 102. This pressurizes a back or rear side of the inlet door 106, preventing it from fully opening. FIG. 2 shows further detail of this known type of inlet 100 and illustrates the basic back-pressure problem with arrows 120.

The following patents, for example, disclose various inlet systems and arrangements:

U.S. Pat. No. 4,378,097 to Ferguson et al.;
U.S. Pat. No. 4,620,679 to Karanian;
U.S. Pat. No. 5,033,693 to Livingston et al.;
U.S. Pat. No. 5,078,341 to Bichler et al.;
U.S. Pat. No. 5,088,660 to Karanian;
U.S. Pat. No. 5,116,251 to Bichler et al.; and
U.S. Pat. No. 6,264,137 to Sheoran.

Specifically, Ferguson et al. disclose a smooth surfaced, submerged air inlet for use generally forwardly of an engine in an aircraft (missile or other air vehicle). The inlet has an opening having wall surfaces adapted to be flush with or inwardly of an aircraft body surface. The wall surfaces of the opening have a leading and outer end in a plane and the surfaces extend inwardly to form an uncovered shallow channel-shaped portion to the inlet, the channel portion deepening inwardly in the trailing direction and continuing into a partial ellipse portion of the opening. The ellipse portion deepens inwardly as it extends in a trailing direction and has substantially parallel wall surfaces extending outwardly of the ellipse in the direction toward the level of the plane. There are extensions of said substantially parallel wall surfaces diverging outwardly to said plane. There is an inwardly trailing surface, spaced outwardly from the partial ellipse portion, being joined to the substantially parallel wall surfaces to form an outer cover for a trailing part of said inlet and of said partial ellipse portion. The inlet, including the cover, trails inwardly and is contoured radially as it trails to form a substantially circular wall surface at its inner end.

The patent to Karanian '679 discloses a two-dimensional inlet for a high speed ram jet missile and includes in combination an educated slot and a single ramp for varying the geometry of the inlet.

Livingston et al. discloses an inlet having a single-piece, flexible inlet ramp skin. A corrugated member is rigidly coupled to the interior surface of the ramp skin to hold the skin rigid in one direction but permit it to be extremely flexible in a second direction. A plurality of beams extends perpendicular to the ridges and grooves of the corrugated member to hold the skin in position in the second direction. Mechanical actuators are coupled to the beams for applying force to vary the shape of the beams and thus the shape of the ramp skin. The inlet area is varied as the ramp skin is moved. The beam member and ramp skin are elastically deformable from an intermediate position in a first direction to increase the area of the inlet and in a second direction to decrease the area of the inlet. Shaping the beam and ramp skin to be at an intermediate position when not deformed permits a greater range of movement and a more variable inlet area for a given material and weight.

Bichler et al. '341 disclose a hydraulically-pivotable inlet ramp with a box-like shaped cross-section for supplying air into engines of supersonic or hypersonic airplanes. The inlet ramp, comprised of a plurality of relatively movable elements, can be adjusted into a number of different positions to optimize air flow under various mach conditions, as well as control a boundary air layer inlet.

The patent to Karanian '660 discloses a supersonic inlet flow duct provided with a pivoting bleed stability door and biasing spring. The door opens under the influence of increased static fluid pressure behind a shock front, which is displaced forwardly by a downstream pressure perturbation. The opened door diverts portions of the inlet duct flow stabilizing the shock front and downstream shock train within the duct until the perturbation subsides.

Bichler et al. '251 disclose an inlet system, which can be used for all supersonic or hypersonic engine inlets and comprises two or several separate parallel ducts, which must be switched over in specific phases of flight. This is accomplished with a duct shaped parallel inlet element pivotably assigned to the inlet ramp of the inlet, which as a channel-connecting re-direction member alternately can close off the turbo-jet inlet duct as well as also the ramjet inlet. Preferably, the construction comprises a plurality of pivotably connected box-like elements interconnected in a movable manner.

The patent to Sheoran discloses an air inlet assembly for bringing air to an auxiliary power unit mounted in the compartment of an aircraft. The assembly includes a duct extending from an intake contoured to conform to the aircraft fuselage to an exit coupled to the inlet plenum of the auxiliary power unit. A first door hingeably mounted to the aft side of said intake and moveable from an open position to a closed position where said first door lies flush against intake, said first door having a closing wall and two side walls and a second door hingeably mounted to the forward end of said intake, said second door having a plate with two inwardly extending walls, each of said inwardly extending walls hinged to one of said side walls so that the second door rotates with said first door. During ground operation, air that would have swirled around the side walls of the first door thus generating inlet corner vortices are now blocked by the side walls of the second door.

It should be understood that the present invention would in fact enhance the functionality of the above patents by providing a high efficiency inlet that can be easily opened under dynamic conditions.

SUMMARY OF THE INVENTION

Therefore it is an object of this invention to provide a high efficiency inlet door.

Another object of this invention is to provide a high efficiency inlet door having a low actuation force.

Still another object of this invention is to provide a high efficiency, low actuation force inlet door that does not adversely affect hydrodynamic flow about the inlet door.

Yet another object of this invention is to control pressure recovery on the inlet door when the inlet door is fully open and reduce back pressure on the inlet door during an initial stage of opening the inlet door.

In accordance with one aspect of this invention, there is provided an inlet system for fluid flow around a moving vehicle includes an inlet recess housing having a substantially vacant interior with forward and rear end walls, a base wall, and an opening formed in an upper surface thereof. An intake duct is formed in a rear end wall of the inlet recess. An inlet door has a first end pivotally connected to a forward wall and a trailing edge directed to the rear end wall of the inlet recess such that the inlet door selectively closes the opening of the inlet recess. An overlap member extends from at least the rear end wall of the inlet recess to a predetermined overlap adjacent a trailing edge of the door. A deflector is provided having an end deflecting portion in contact with the trailing edge of the door over a predetermined arcuate distance and side deflecting portions projecting from the end deflecting portion toward the front wall of the inlet recess. The deflector arrangement controls pressure recovery of fluid at a fully open position of the door and controls a pressure on a recess side of the door until the trailing edge of the door clears the end deflecting portion of the deflector in a fluid flow direction from the inlet door to the intake duct.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF THE PREFERRED EMBODIMENT

Figure 3A:
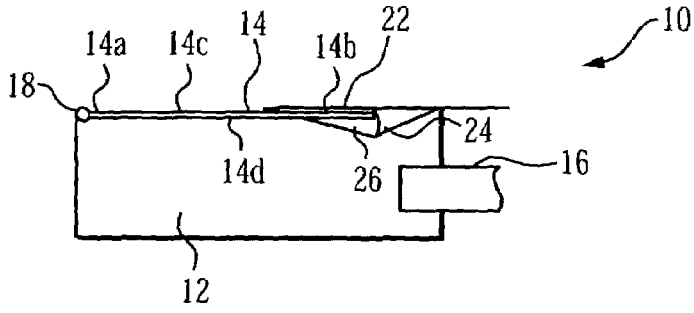
FIGS. 3A, 3B, and 3C are side schematic views of a high efficiency inlet system at varying stages of operation according to a preferred embodiment of the present invention.
Figure 3B:
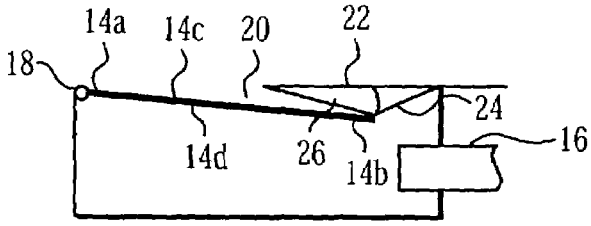
Figure 3C:
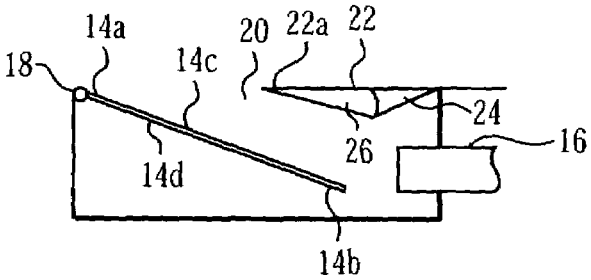

Referring to FIGS. 3A, 3B and 3C, the features of an inlet system 10 are shown at three stages of operation. The inlet system includes several primary components including an inlet recess 12 of a substantially rectangular shape and built into the ship hull (not shown in FIG. 3). This enclosure serves as a housing for all mechanisms and allows an intake door 14 to open and close without interference from other hull systems. The inlet recess 12 is nominally isolated from other ship compartments, thereby preventing fluid from flowing through the inlet recess 12 and into other compartments. Flow is constrained to flow through the inlet recess and into an intake duct 16.

The inlet door 14 is essentially a trap door mounted by at least one hinge member 18 at a leading edge 14*a* of the door 14. A longitudinal axis of the inlet door 14 is aligned with a mean flow direction of an external flow over the vessel hull. The inlet door 14 is opened using large hydraulic systems (not shown) connected to a side 14*d* of inlet door 14 facing the inlet recess 12. Any linear actuator having the necessary opening and closing force can be used to open the door.

Figure 1:
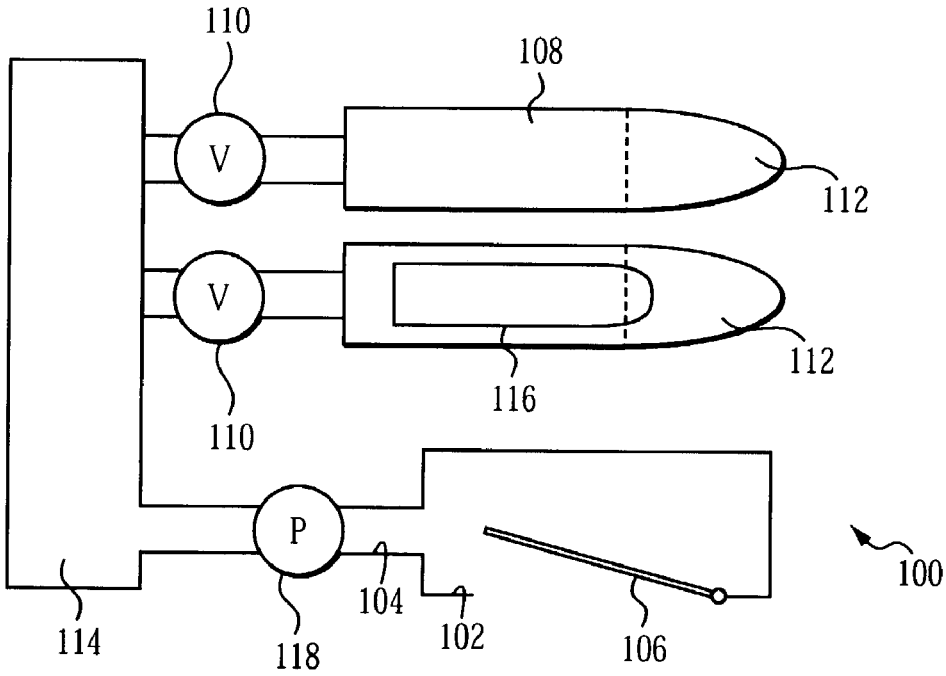
FIG. 1 PRIOR ART
FIG. 1 is a schematic diagram of a prior art ejection system.
Figure 2:
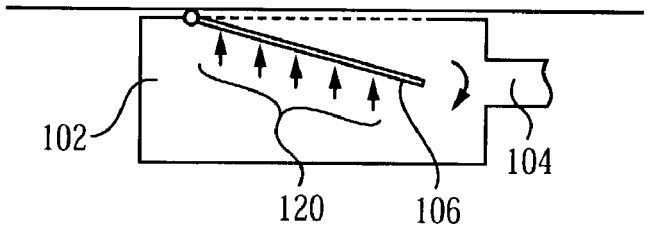
FIG. 2 PRIOR ART
FIG. 2 is a side schematic view of a prior art high efficiency inlet for use in the system of FIG. 1.

Fluid is drawn from the inlet recess 12 to a turbine pump (see FIG. 1) through the intake duct 16. An entrance to the intake duct 16 faces that part of the inlet recess 12 adjacent an inlet door opening 20 shown in FIGS. 3B and 3C. Minimal flow restrictions exist between the intake duct 16 and the door opening 20.

An overlap 22 is provided which covers or overlays a portion of the inlet door 14 adjacent a trailing edges 14*b* thereof. This overlap 22 helps form a high pressure cavity on the top surface 14*c* of the intake door 14 as it begins to open.

Figure 4:
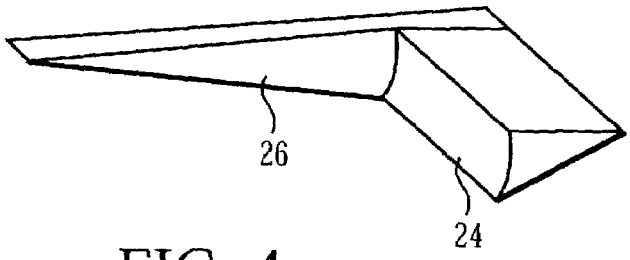
FIG. 4 is a detail perspective view of a portion of the system shown in FIGS. 3A, 3B and 3C.

An intake fence 24 is placed at the trailing edge 14*b* of the intake door 14. A sliding seal is provided between the trailing edge 14*b* of the intake door 14 and the intake fence 24. The intake fence 24 and resultant seal prevent flow and pressure communication between an area above the inlet door 14 and the inlet recess 12 during initial opening of the inlet door 14. A detail view of the intake fence 24 and side shields 26 is provided as FIG. 4. In FIG. 4, one side shield 26 is not shown.

Side shields 26 are provided to prevent flow and pressure communication between the area over the intake door 14 and the inlet recess 12 as door 14 begins to open. The side shields 26 extend from opposing edges of the intake fence 24 and below a planar surface of the overlap 22 so as to physically fit within the inlet recess 12. A sliding seal between outer edges of the inlet door 14 and the side shields 26 is needed to prevent flow around the edges of the inlet door 14.

The combination of the overlap 22, intake fence 24, and side shields 26 integrate to improve pressure recovery performance, and prevent excessive back pressure from interfering with opening of the intake door 14. As the intake door 14 begins to open (FIG. 3B), a high velocity flow is directed between the overlap 22 and the top surface 14*c* of the inlet door 14. The cavity formed between the top surface

14*c* of intake door 14, side shields 26, and intake fence 24 is pressurized with the recovered dynamic pressure. As a result, there is a large opening force on the intake door 14. Because sealing of the side shields 26 and the intake fence 24 are not perfect with the perimeter of the inlet door 14, some flow is forced into the intake recess 12. A predetermined amount of flow is allowed to escape through the hinges 18 and gaps in the side shields 26 upstream of the overlap 22 (outside of the pressurized cavity formed above the inlet door 14). This predetermined flow allows some pressurization of the intake recess 12. Without this flow, the inlet door 14 would have to be forced shut to overcome the pressure forces above the inlet door 14.

This flow control arrangement is maintained until the inlet door 14 opens sufficiently far for the pressure recovery effectiveness of the door to drop substantially (from nearly 100% at a few degrees open angle to approximately 30% at 15 degrees open angle). When the trailing edge 14*b* of the inlet door 14 passes the bottom of the intake fence 24, the cavity above the inlet door 14 comes into immediate communication with the inlet recess 12. A sudden rise in pressure of the inlet recess 12 increases back-pressure on the inside 14*d* of the inlet door 14. The intake fence 24 and side shields 26 are designed so that when this communication occurs, the resulting forces on the inlet door 14 are well within the opening actuation force of the hydraulic system for the inlet door 14.

As shown in FIG. 3C, the inlet door 14 continues to open until the trailing edge 14*b* of the inlet door 14 and the bottom of the intake fence 24 entirely expose the intake duct 16.

The presence of the overlap 22 has a secondary function of improving the pressure recovery of the inlet recess 12. A sharp outer edge 22*a* of the overlap 22 tends to direct high velocity external flow into the recess 12 and intake duct 16. The inlet door 14 herein eliminates any back pressurization that can prevent opening of the inlet door 14 and improves the pressure recovery performance of the entire inlet system 10. The combined effect of the intake fence 24, side shields 26, and overlap 22 is to create a pressurized cavity above the intake door 14 during the initial opening of the door and thereby compensates for the pressurization of the recess 12.

It will be understood that the arrangement presented herein can be modified in many ways in order to achieve the desired result. Examples of alternate configurations include retractable side shields and fences that can be removed when the door is fully open; and controlling the gap between the fence and the door to adjust a force on the door. It is also possible to eliminate the need for high power hydraulics by restricting the flow with sufficient control to adjust the relative pressure above and below the intake door. The elimination of high-powered hydraulics can significantly reduce the cost of the intake door system.

In view of the above detailed description, it is anticipated that the invention herein will have far reaching applications other than those described.

This invention has been disclosed in terms of certain embodiments. It will be apparent that many modifications can be made to the disclosed apparatus without departing from the invention. Therefore, it is the intent of the appended claims to cover all such variations and modifications as come within the true spirit and scope of this invention.

What is claimed is:

1. An inlet system for fluid flow comprising:

an inlet housing having a forward wall, a rear end wall, a base wall, and an opening formed in an upper surface thereof;

an intake duct formed in said rear end wall of said inlet housing;

an inlet door having a first edge pivotally connected to a forward wall of said inlet housing and a trailing edge directed to the rear end wall of said inlet housing, said inlet door being capable of selectively closing the inlet housing opening;

an end deflecting portion positioned in said inlet housing and sealable against the trailing edge of said inlet door over at least a portion of the inlet door's pivoting path; and side deflecting portions positioned in said inlet housing and sealable against said inlet door wherein said side deflecting portions are substantially triangular with a base of the triangle mounted to the end deflecting portion and an apex of the triangle terminating a distance away from the end deflecting portion.

2. The system according to claim 1 further comprising hinges, pivotally connecting said inlet housing to said inlet door.

3. The system according to claim 1 further comprising an overlap formed as part of said inlet housing and extending into said inlet housing opening from said rear end wall, said overlap preventing outward opening of said inlet door.

4. The system according to claim 1 wherein the said end deflecting portion transverses an entire width of said inlet recess housing.

5. An inlet system for fluid flow comprising:

an inlet housing having a forward wall, a rear end wall, a base wall, and an opening formed in an upper surface thereof;

an intake duct formed in said rear end wall of said inlet housing;

an inlet door having a first edge pivotally connected to a forward wall of said inlet housing and a trailing edge directed to the rear end wall of said inlet housing, said inlet door being capable of selectively closing the inlet housing opening;

an end deflecting portion positioned in said inlet housing and sealable against the trailing edge of said inlet door over at least a portion of the inlet door's pivoting path, wherein said end deflecting portion is positioned within said inlet recess housing and above said intake duct.

6. The system according to claim 5 wherein said end deflecting portion includes an arcuate face corresponding to an arcuate path of the trailing edge of said inlet door over a predetermined distance.

7. An inlet system for fluid flow comprising:

an inlet housing having a forward wall, a rear end wall, a base wall, and an opening formed in an upper surface thereof;

an intake duct formed in said rear end wall of said inlet housing;

an inlet door having a first edge pivotally connected to a forward wall of said inlet housing and a trailing edge directed to the rear end wall of said inlet housing, said inlet door being capable of selectively closing the inlet housing opening;

an end deflecting portion positioned in said inlet housing and sealable against the trailing edge of said inlet door over at least a portion of the inlet door's pivoting path, wherein said end deflecting portion includes an arcuate face corresponding to an arcuate path of the trailing edge of said inlet door over a predetermined distance.

* * * * *